US010708683B2

(12) United States Patent
Balistreri

(10) Patent No.: US 10,708,683 B2
(45) Date of Patent: Jul. 7, 2020

(54) SPEAKER SYSTEM

(71) Applicant: Klipsch Group, Inc., Indianapolis, IN (US)

(72) Inventor: Riccardo Balistreri, Indianapolis, IN (US)

(73) Assignee: KLIPSCH GROUP, INC., Indianapolis, IN (US)

( * ) Notice: Subject to any disclaimer, the term of this patent is extended or adjusted under 35 U.S.C. 154(b) by 0 days.

(21) Appl. No.: 16/354,020

(22) Filed: Mar. 14, 2019

(65) Prior Publication Data

US 2019/0289389 A1 Sep. 19, 2019

Related U.S. Application Data

(60) Provisional application No. 62/642,696, filed on Mar. 14, 2018.

(51) Int. Cl.

| | |
|---|---|
| ***H04R 1/00*** | (2006.01) |
| ***H04R 1/26*** | (2006.01) |
| ***H04R 5/02*** | (2006.01) |
| ***H04R 7/12*** | (2006.01) |
| ***H04R 1/02*** | (2006.01) |

(52) U.S. Cl.

CPC ..... *H04R 1/26* (2013.01); *H04R 1/023* (2013.01); *H04R 5/02* (2013.01); *H04R 7/127* (2013.01)

(58) Field of Classification Search

CPC . H04R 1/00; H04R 1/02; H04R 1/023; H04R 1/026; H04R 1/26; H04R 7/00; H04R 7/12; H04R 7/127; H04R 7/24; H04R 9/02; H04R 9/06; H04R 23/00; H04R 5/02

See application file for complete search history.

(56) References Cited

U.S. PATENT DOCUMENTS

| | | | | |
|---|---|---|---|---|
| 4,146,110 A * | 3/1979 | Maloney | H04R 1/24 | 181/147 |
| 4,182,429 A * | 1/1980 | Senzaki | H04R 1/24 | 181/141 |
| 5,004,067 A * | 4/1991 | Patronis | H04R 1/30 | 181/188 |
| 5,872,339 A * | 2/1999 | Hanson | H04R 1/26 | 181/144 |
| 2004/0179710 A1* | 9/2004 | Farinelli, Jr. | H04R 1/025 | 381/386 |

FOREIGN PATENT DOCUMENTS

JP 2008278233 A * 11/2008

* cited by examiner

*Primary Examiner* — Thang V Tran
(74) *Attorney, Agent, or Firm* — Quarles & Brady LLP

(57) ABSTRACT

A speaker system is provided herein that includes a frame at least partially encompassing a diaphragm of a first transducer. A bridge is operably coupled with the frame. The bridge includes a support section and a pair of arms extending therefrom, the support section including a rim portion. A second transducer is supported by the bridge and at least partially disposed within the rim portion. A first sound altering feature is disposed on a first side of the second transducer. An asymmetrical second sound altering feature is disposed on a second opposing side of the second transducer.

17 Claims, 19 Drawing Sheets

SPEAKER SYSTEM

CROSS-REFERENCE TO RELATED APPLICATION

This application claims the benefit of U.S. provisional patent application Ser. No. 62/642,696, filed on Mar. 14, 2018, the full disclosure of which is incorporated herein by reference.

FIELD OF THE INVENTION

The present disclosure generally relates to a speaker system.

BACKGROUND OF THE INVENTION

Acoustics modules within currently available software has allowed for an easier setup of acoustic simulations. It is now practical to use of an impulse response analysis in Time Domain. A Fourier Transform of the results can give an idea of the behavior in the frequency response for a quick optimization. A more detailed inspection in Frequency Domain is possible by mapping results from Time Domain so that a far field can be calculated. Additional analysis time is saved by focusing only on frequencies of interest within the same model which, when thinking of iterative changes, speeds up optimization of the geometries for the intended design target.

New speaker systems may be tested and modeled with the acoustics modules leading to enhanced speaker systems when compared to conventional speaker assemblies.

SUMMARY OF THE INVENTION

According to some aspects of the present disclosure, a speaker system is disclosed that includes a frame at least partially encompassing a first diaphragm of a first transducer. A bridge is operably coupled with the frame. The bridge includes a support section and a pair of arms extending therefrom, the support section including a rim portion. A second transducer is supported by the bridge and at least partially disposed within the rim portion. A first sound altering feature is disposed on a first side of the second transducer. An asymmetrical second sound altering feature disposed on a second opposing side of the second transducer.

According to some aspects of the present disclosure, a speaker system is disclosed that includes a frame at least partially encompassing a first diaphragm of a first transducer. A bridge is operably coupled with the frame. The bridge includes a support section and a pair of arms extending therefrom, the support section including a rim portion. A second transducer is supported by the bridge and at least partially disposed within the rim portion. One or more dimples is defined by the support section of the bridge. At least one of the one or more dimples is defined by an asymmetrical geometric shape.

According to some aspects of the present disclosure, a speaker system is disclosed that includes a frame at least partially encompassing a first diaphragm of a first transducer. A bridge is operably coupled with the frame. The bridge includes a support section and a pair of arms extending therefrom. The support section includes a rim portion. An asymmetrical protrusion extends from the rim portion.

These and other aspects, objects, and features of the present invention will be understood and appreciated by those skilled in the art upon studying the following specification, claims, and appended drawings.

DETAILED DESCRIPTION OF THE PREFERRED EXAMPLES

Figure 1:
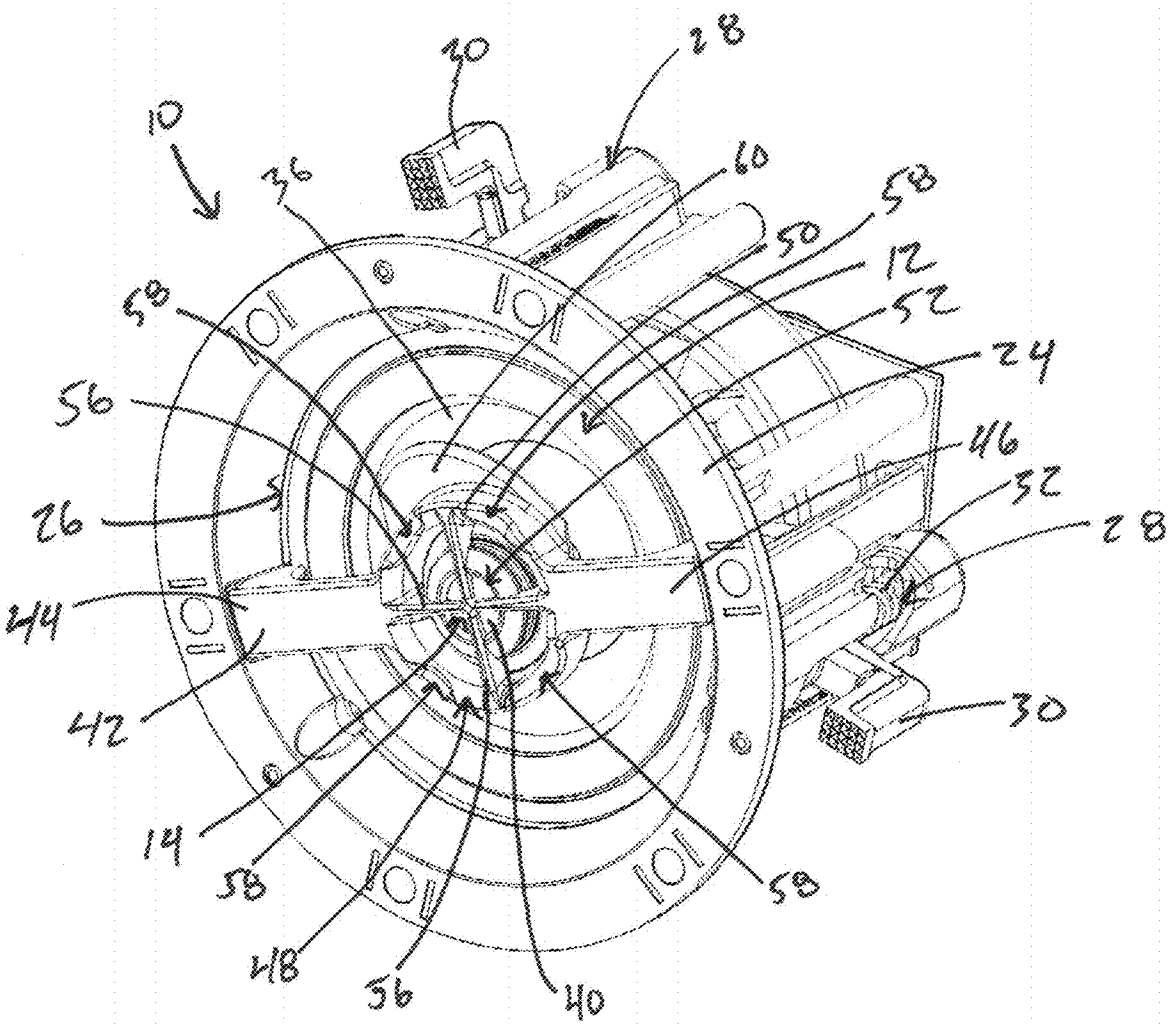
FIG. 1 is a front perspective view of a speaker system, according to some examples.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary examples of the inventive concepts defined in the appended claims. Hence, specific dimensions and other physical characteristics relating to the examples disclosed herein are not to be considered as limiting, unless the claims expressly state otherwise.

As required, detailed examples of the present invention are disclosed herein. However, it is to be understood that the disclosed examples are merely exemplary of the invention that may be embodied in various and alternative forms. The figures are not necessarily to a detailed design and some schematics may be exaggerated or minimized to show function overview. Therefore, specific structural and functional details disclosed herein are not to be interpreted as limiting, but merely as a representative basis for teaching one skilled in the art to variously employ the present invention.

In this document, relational terms, such as first and second, top and bottom, and the like, are used solely to distinguish one entity or action from another entity or action, without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises . . . a" does not, without more constraints, preclude the existence of additional identical elements in the process, method, article, or apparatus that comprises the element.

As used herein, the term "and/or," when used in a list of two or more items, means that any one of the listed items can be employed by itself, or any combination of two or more of the listed items can be employed. For example, if any assembly or composition is described as containing components A, B, and/or C, the assembly or composition can contain A alone; B alone; C alone; A and B in combination; A and C in combination; B and C in combination; or A, B, and C in combination.

In signal processing, the impulse response, or impulse response function (IRF), of a dynamic system is its output when presented with a brief input signal, called an impulse. More generally, an impulse response is the reaction of any dynamic system in response to some external change. In both cases, the impulse response describes the reaction of the system as a function of time (or possibly as a function of some other independent variable that parameterizes the dynamic behavior of the system). In all these cases, the dynamic system and its impulse response may be actual physical objects, or may be mathematical systems of equations describing such objects.

Since the impulse function contains all frequencies, the impulse response defines the response of a linear time-invariant system for all frequencies. Mathematically, how the impulse is described depends on whether the system is modeled in discrete or continuous time. The impulse can be modeled as a Dirac delta function for continuous-time systems, or as the Kronecker delta for discrete-time systems. The Dirac delta represents the limiting case of a pulse made short in time while maintaining its area or integral (thus giving an infinitely high peak). In Fourier analysis theory, such an impulse comprises equal portions of all possible excitation frequencies, which makes it a convenient test probe.

Any system in a large class known as linear, time-invariant (LTI) is characterized by its impulse response. That is, for any input, the output can be calculated in terms of the input and the impulse response. The impulse response of a linear transformation is the image of Dirac's delta function under the transformation, analogous to the fundamental solution of a partial differential operator. In some instances, it may be easier to analyze systems using transfer functions as opposed to impulse responses. The transfer function is the Laplace transform of the impulse response. The Laplace transform of a system's output may be determined by the multiplication of the transfer function with the input's Laplace transform in the complex plane, also known as the Frequency Domain. An inverse Laplace transform of this result will yield the output in the Time Domain.

In acoustics, impulse response can be used for the responses' transformation from Time Domain to Frequency Domain of linear time-invariant systems (to which, with some constraints, a loudspeaker transducer may be configured as). In the discrete world (digital or numerical simulation), if given an input sequence x(n) to a system whose impulse response sequence is h(n), the output sequence y(n) is attained through a convolution sum (a form of integral transformation indicated with "*" for the discrete values) of the following equation:

$$y(n)=h(n)*x(n) \tag{1}$$

which, expressed is terms of a z-transform (Laplace transform equivalent acting on the discrete values), may be shown by the following equation:

$$Y(z)=H(z)X(z), \tag{2}$$

which can be solved for the transfer function H(z), which when evaluated on the unit circle, allows for derivation of the frequency response.

For implementation in the model, considering that the impulse response can be seen as a Gaussian where the sigma limit is equal to zero, a Gaussian pulse can be a good candidate. Thus, the Gaussian pulse may also be used in modeling software, thus leaving alleviating doubt in terms of model's solution convergence. This helps the setup of the speaker modeling as, based on the target range of frequency spectrum that needs to be resolved, the pulse can be defined so that the maximum frequency in its spectral content matches it. For example, a tweeter (a transducer which may be designed to reproduce a higher portion of the audible frequency spectrum, for example, 2,000 to 16,000 kHz), the Gaussian pulse thus will be defined so that if f0 is equal to the highest frequency examined may be expressed by the following equation:

$$1[m/s]*\exp f0(-pi\hat{}2*f0\hat{}2*(t-T0f0)\hat{}2). \tag{3}$$

Equation 3 can be placed as an analytic formula for the diaphragm velocity, Vin, with "t" being time [s] and f0 [Hz] passed as a parameter together with T0 defined as 1/f0.

In various examples, the idea of such study is to observe the impulse propagation in the Time Domain, retrieve locally within the domain, frequency response, then innovate new speaker system geometries with the option to investigate troubled frequency ranges with the Frequency Domain analysis for the details in polar response, far field and use a full Multiphysics simulation at the end to obtain detailed data.

In some instances, a Perfectly Matched Layer (PML) is a domain defined with a construct that will seamlessly avoid incident pressure waves to return values back in computation, simulating total absorption of energy, like an anechoic environment would do. In some software applications utilizing the Frequency Domain, its formulation is such that it does requires minimal attention in the setup. In some software applications utilizing the Time Domain, the PML brings the same advantages, truncating properly the computational domain, saving degrees of freedom by reducing domain size, and/or reducing computational time. Alas, as it is, extra caution may be needed in the setup when in the Time Domain because its thickness is important for it to function well.

As a guideline, in some software applications, such as COMSOL, the thickness of the PML can be set to at least an eighth of the longest wavelength to be simulated. For example, when the subject is a tweeter and not having interest in behaviors below 1000 Hz, the PML can be set to be around 50 mm wide. Moreover, at least six layers in structured mesh may be utilized. Similar consideration goes for the main computational domain. As the mesh size needs to be able to resolve the impulse in time needs to be considered. So, based on the speed of sound and the period T0, a reasonable mesh size could be a sixth the distance as maximum element size, and a tenth as minimum according to some examples.

Boundary layer thickness towards the PML can also be important and could be set to approximately 1/50 of the distance covered in T0. Once those criterions are applied, it is possible to run a solution for equation 1 above. That can be attempted considering, again, as length of analysis time the pulse duration plus the domain width time of flight, and with a factor that there will be residual perturbances coming from reflections within the domain geometries that we would also include (the distance can get related to T0 with an integer unit to have, for example, six times T0). The intervals that will give an optimal resolution of the impulse curve could be to the order of less than ½ or a fraction that then completes the range properly (for example, ½ can work well with a time range lasting 6·T0).

A fast Fourier transform (FFT) is an algorithm that computes the discrete Fourier transform (DFT) of a sequence, or its inverse (IDFT). Fourier analysis converts a signal from its original domain (time or space) to a representation in the Frequency Domain and vice versa. To implement an FFT to the solution, an FFT is computed with the appropriate parameters, as desired. In some programs, an opportunity to apply a windowing function in order to attain more useful data from the results the mapping of that solution to a Frequency Domain may be necessary.

Making use of the same model, but this time adding a Frequency Domain physics will give the possibility to get the far field analysis and its features like polar plots and frequency response in the far field. This is realized by using the default parts of the physics definition, but changing its equation form to study controlled, so that the equations and pressure field values are coming from the Time Domain study.

Through the usage of the analysis provided herein, new and improved speaker systems may be created. The new speaker system can include various sound altering features that may be configured to alter an off-axis and/or on-axis frequency response of the speaker output at various frequencies as modeled in the Time Domain and/or the Frequency Domain. The alteration of the off-axis and/or on-axis frequency response can diffuse standing sound waves to provide a crisper and clear audio sound over a wider range of frequencies when compared to conventional speakers. The sound altering features may include one or more dimples, which may be asymmetrical, and/or one or more protrusions, which may also be asymmetrical. These features can be provided on a modified bridge that includes minimizing the cost of enhancing the functionality of the speaker.

A speaker system can include any number of electroacoustic transducers, which are devices that convert an electrical audio signal into a corresponding sound that may be modeled using the processes described herein after development. For example, as illustrated in FIG. 1, a speaker system 10 includes first and second transducers 12, 14. In some embodiments, the first transducer 12 may be configured as a woofer or low frequency transducer and the second transducer 14 may be configured as a tweeter or high frequency transducer. The first transducer 12 can be configured for reproducing low frequency sounds through the use of permanent-magnet, moving coil including a magnet circuit, a magnet 16, a bottom plate 18, a pole piece 20 and a top plate 22. The low frequency sounds possibly below 200 Hz. A frame 24 is secured to the top plate 22. The frame 24 has a generally conical configuration and defines an open space 26 which is also generally the frontal area of the first transducer 12. The shape of the open space 26 formed by the frame 24 can be other than circular shaped, such as oval shaped, rectangular shaped, etc.

The frame 24 may also be operably coupled with a retaining assembly that is configured to retain the speaker system 10 in a predefined location. For example, the speaker assembly may include a mounting system 28 that includes legs 30 that engage with a structure defining a cutout hole to support the speaker system 10. In some examples, the support structure may be a wall or ceiling panel of a building. The mounting system 28 can define a preset clamping force through the use of a spring 32 that eliminates the possibility of over-torqueing during installation. In some examples, the mounting system 28 can be tool-free, fast, thereby creating an easy installation system that reduces install time and provides solid, reliable installation.

A damper 34 has an outer edge which is mounted to the frame 24 and an inner edge which is coupled to an inner edge of a first diaphragm 36. The first diaphragm 36 extends or flares generally conically and may be attached to the frame 24 through the use of a suspension surround. The suspension surround enables movement of the first diaphragm 36 in reference to the frame 24 as sound is produced by the speaker system 10. The movement may be in a substantially forwardly and rearwardly direction along a first axis extending from the center point of the first diaphragm 36. Alternately, the first diaphragm 36 may move along any other axis without departing from the teachings provided herein. Both the damper 34 and the first diaphragm 36 are mounted within the open space 26 of the frame 24. The coupled inner edges of the damper 34 and the first diaphragm 36 form a central opening 38. A central portion of the first diaphragm 36 can be attached to a voice coil bobbin which can carry a voice coil.

The second transducer 14 can be configured for reproducing high frequency sounds, such as a tweeter. The high frequency sounds may be in the frequency range of from around 2,000 Hz to 20,000 Hz, and possibly up to or above 100,000 Hz. The second transducer 14 includes a second diaphragm 40 that is configured to move in reference to the frame 24 as sound is produced by the speaker system 10. The movement may be in a substantially forwardly and rearwardly direction along a second axis extending from the center point of the second diaphragm 40. Alternately, the second diaphragm 40 may move along any other axis without departing from the teachings provided herein. The second transducer 14 moves along a second axis that is offset from a first movement axis of the first transducer 12, or the axes of the first and second transducers 12, 14 may be aligned with one another. The second diaphragm 40 of the second transducer 14 can have a smaller dimension than that of the first diaphragm 36. The speaker system described herein may include any number of transducers that are configured to output sound in any frequency range. For example, the speaker system may include one or more transducers that output similar or varied frequency ranges. Further, multiple drivers, or transducers, (e.g., subwoofers, woofers, mid-range drivers, and tweeters) can be combined in the speaker system. In addition, the transducers may be configured as sound radiation systems that utilize a cone driver, a dome driver, a horn type driver, and/or any other type of driver.

The second transducer is supported in a position in front of the first transducer through a bridge. In some embodiments, such as the example illustrated in FIGS. 1-3, a bridge 42 extends across the open space 26 defined by the frame 24. The bridge 42 can include opposing arms 44, 46 that operably couple with the frame 24 and a support section 48 that defines an attachment location for the second transducer 14. As provided herein, the second transducer 14 moves along a second axis that is offset from a first movement axis of the first transducer 12. Accordingly, a first arm 44 of the pair of arms 44, 46 can be a first length and a second arm 46 of the pair of arms 44, 46 can be a second length that is varied from the first length.

The support section 48 of the bridge 42 can include a generally circular rim portion 50 that defines a cavity 52. The second transducer 14 is operably coupled to the bridge 42 with the second diaphragm 40 substantially aligned with at least a portion of the cavity 52. In some examples, the second transducer 14 is positioned between an outer surface of the support section 48 of the bridge 42 and the first transducer 12. In such instances, the second transducer 14 can be operably coupled with a rear surface of the bridge 42 through the use of fasteners, adhesives, etc. In some examples, a portion of the second transducer 14 may be operably coupled with an outer surface of the support section 48. Accordingly, in some examples, the rim portion and an outer rim portion of the second diaphragm of the second transducer may be have similar geometries. However, in some examples, the rim portion and the second diaphragm may have varied geometries relative to one another.

Figure 2:
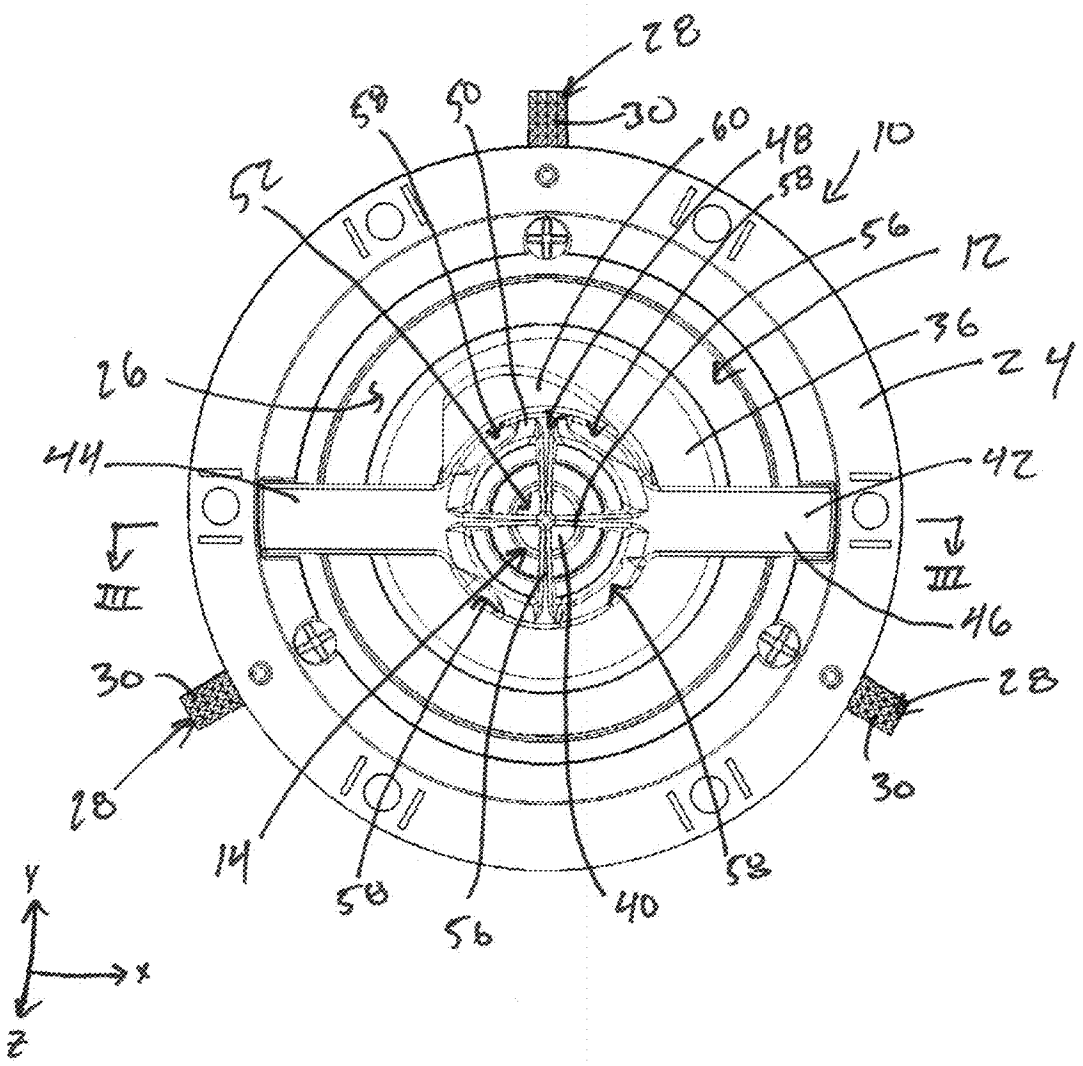
FIG. 2 is a front plan view of the speaker system, according to some examples.
Figure 3:
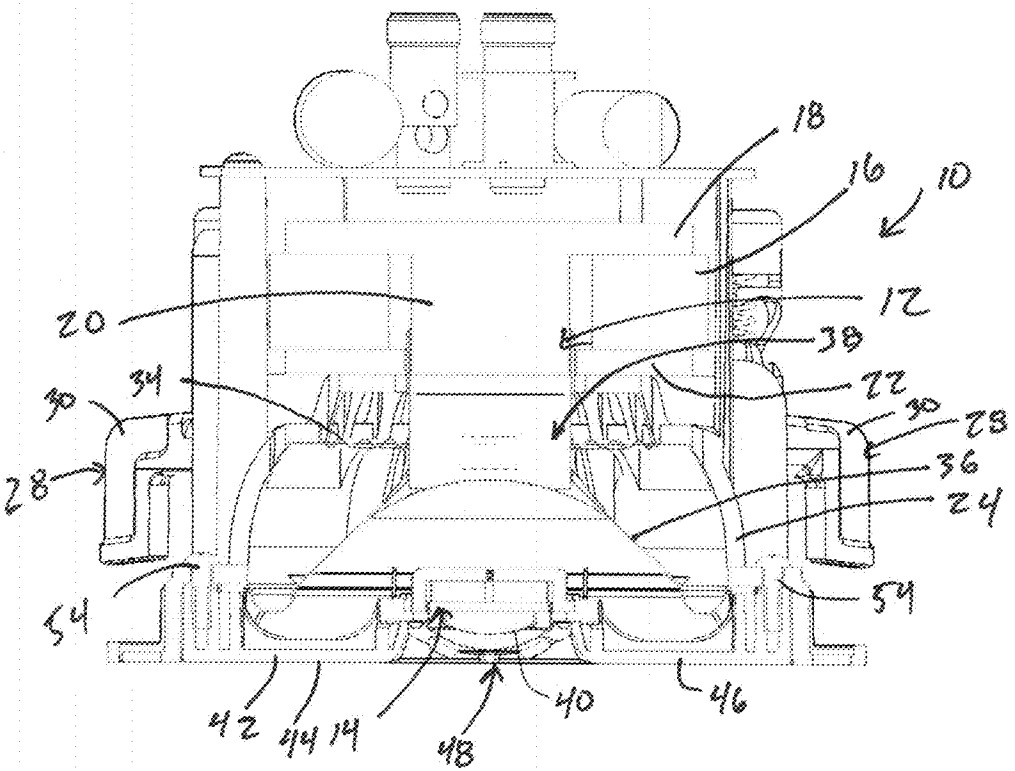
FIG. 3 is a cross-sectional view of the speaker system taken along the line III-III of FIG. 2.
Figure 4:
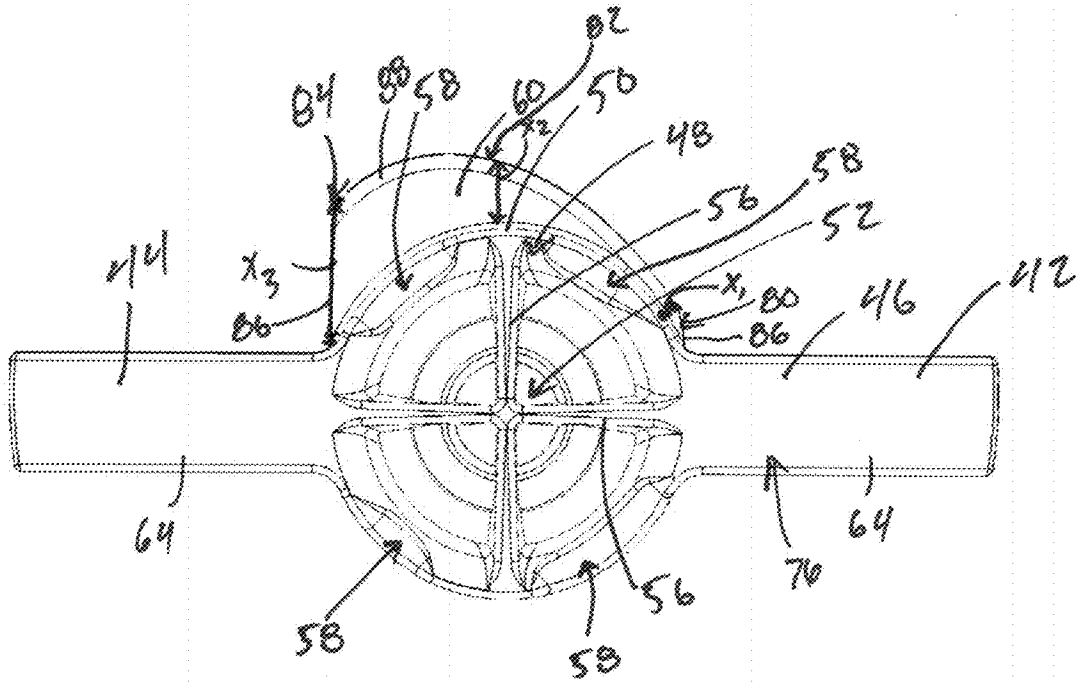
FIG. 4 is a front plan view of a bridge of the speaker system, according to some examples.
Figure 5:
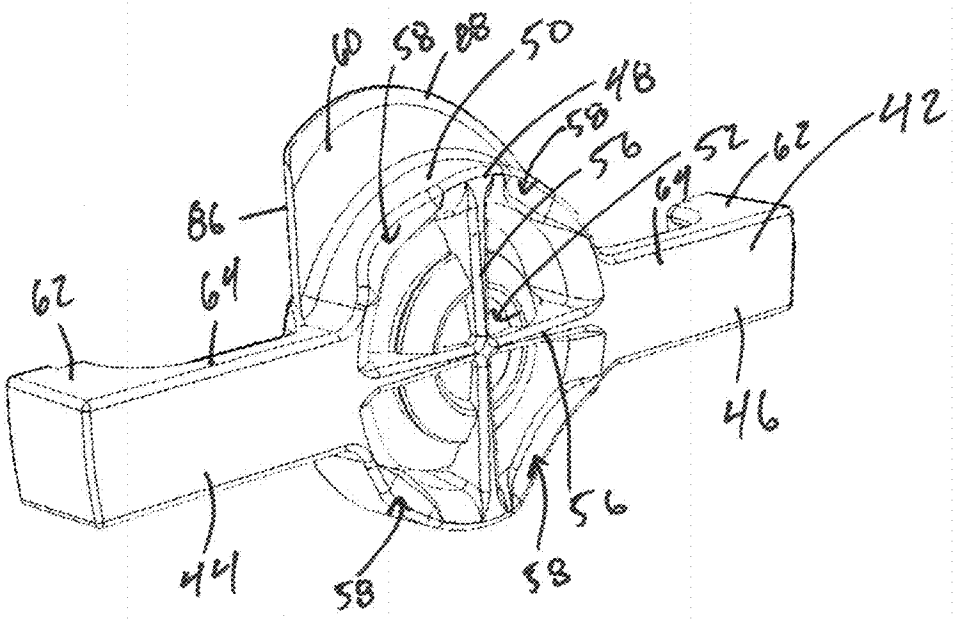
FIG. 5 is a front perspective view of the bridge of FIG. 4.

In some examples, such as the one illustrated in FIGS. 1-12B, one or more vanes may extend at least partially over the cavity 52. For example, as illustrated in FIGS. 1-3, a pair of integrally formed vanes may extend over the cavity 52 and intersect with one another. In some instances, the intersection point may align with the axis of the second transducer 14. Any number of vanes may extend over the cavity 52 without departing from the present disclosure. However, in some embodiments, the bridge 42 may be free of vanes extending over the cavity 52.

The bridge 42 may also include various frequency altering features. For example, one or more dimples 58 may be integrally formed within a rim portion 50. In addition, a protrusion 60 may extend from the support section 48. The protrusion 60 may be integrally formed with other portions of the bridge 42 or later attached thereto. The dimples 58 and/or the protrusion 60 may be configured to alter an off-axis and/or on-axis frequency response of the speaker output at various frequencies forming a sound altering waveguide feature.

A grill made of metal or plastic material is detachably attached on an outer arm of the frame 24. The grill is provided for the purpose of covering the open space 26 of the first transducer 12 and the second transducer 14. The speaker system 10, however, can be used without the grill as shown in FIGS. 1-3. Moreover, the grill may be of any shape (circular, square, etc.) and may be attached to the frame 24 through fasteners, magnets, adhesives, or the like.

The bridge may be configured to support the second transducer and is operably coupled with the frame. In some embodiments, such as the example illustrated in FIGS. 4-12B, the bridge 42 is coupled with two portions of the frame 24 (FIG. 1.), which can add rigidity to the speaker system 10 thereby preventing damage to the first or second transducer 14. In the example illustrated in FIGS. 4-12B, the arms 44, 46 and the support section 48 are integrally formed as a single component extending between two opposing sides of the frame 24. However, the bridge 42 may be formed of any number of parts. The bridge 42 may be formed from any polymeric material, elastomeric material, metallic material, and/or combinations thereof and through any practicable manufacturing process, such as injection molding.

In some embodiments, each arm 44, 46 of the bridge 42 includes a first section 62 and a second section 64. The first section 62 may extend in a first direction while the second section 64 extends can in extend in a second, offset direction. In some instances, the first section 62 may extend in a direction that is perpendicular to the second section 64. The first section 62 can define a fastener void 66 and/or a slot 68. A fastener 54 (FIG. 3) may be inserted through the frame 24 and into the fastener void 66 for coupling the bridge 42 to the frame 24.

The second section 64 of the arms 44, 46 can define a channel 70 therethrough that is substantially perpendicular to the slot 68. The first section 62 of the arms 44, 46 may also define an access void 72 that provides access between the slot 68 and the channel 70. The support section 48 further defines an access opening 74 at an opposing end of the channel 70 from the access void 72. In some instances, electrical wires provide power to the second transducer 14 and are disposed within the channel 70 and/or the slot 68 such that they can be retained and concealed from an outer side 76 of the bridge 42. Accordingly, one or more retainers may also be disposed within the channel 70 and/or the slot 68 that operably couple with the electrical wires to further maintain the wires within the channel 70 and/or slot 68.

The support section of the bridge can be integrally formed with the arms and includes a rim portion. In some examples, the rim portion may at least partially surround the second transducer and may extend forwardly and/or rearwardly of the installed second transducer. In some embodiments, such as the example illustrated in FIGS. 4-12B, centering ribs 78 may extend inwardly from the rim portion 50 to assist in placing the second transducer 14 in a predefined location within the rim portion 50.

In addition to supporting the second transducer in front of the first transducer, possibly in an offset orientation, the support section, or other portions of the bridge, may include various frequency altering features. For example, according to the embodiment illustrated in FIGS. 4-12, the support section 48 of the bridge 42 includes variously-sized dimples 58. As illustrated, the dimples 58 may be integrally formed in the rim portion 50 of the support section 48. The dimples 58 may be defined by an arc of a continuous radius or thickness, or may have varied sections throughout the arc defining each respective dimple 58.

In some embodiments, such as the example illustrated in FIGS. 4-12, the rim portion 50 may include a set of four dimples 58 that have varied shapes relative to at least one other dimple 58. For example, some of the dimples 58 may have a radial width that is greater than other dimples 58. The set of four dimples 58 can be separated by the vanes of the support section 48. Each of the dimples 58 may be of a varied size relative to at least one of the other dimples 58. The dimples may also be disposed at varied radial distances from one another such that the distance between any two dimples may be varied from that of at least one other pair of dimples. In some embodiments, the radial distance between one side portion of the dimple and an adjacently disposed vane may be varied from the opposing side portion of the respective dimple and a respective adjacently disposed vane.

Figure 6:
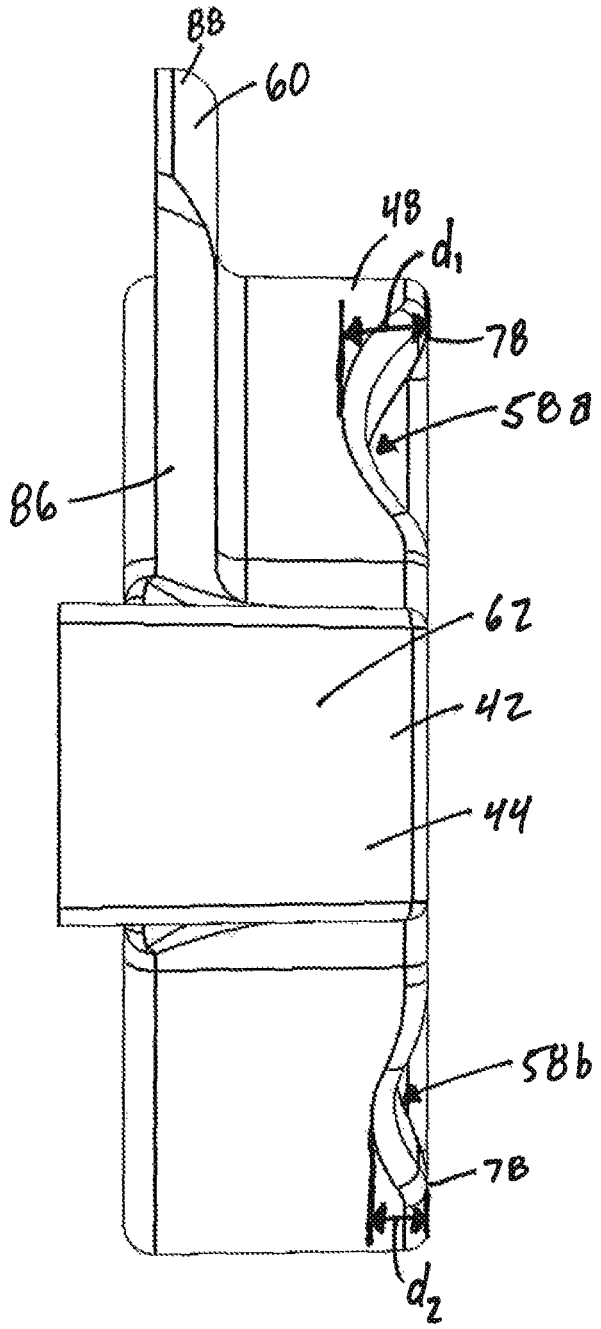
FIG. 6 is a side plan view of the bridge of FIG. 4.
Figure 7:
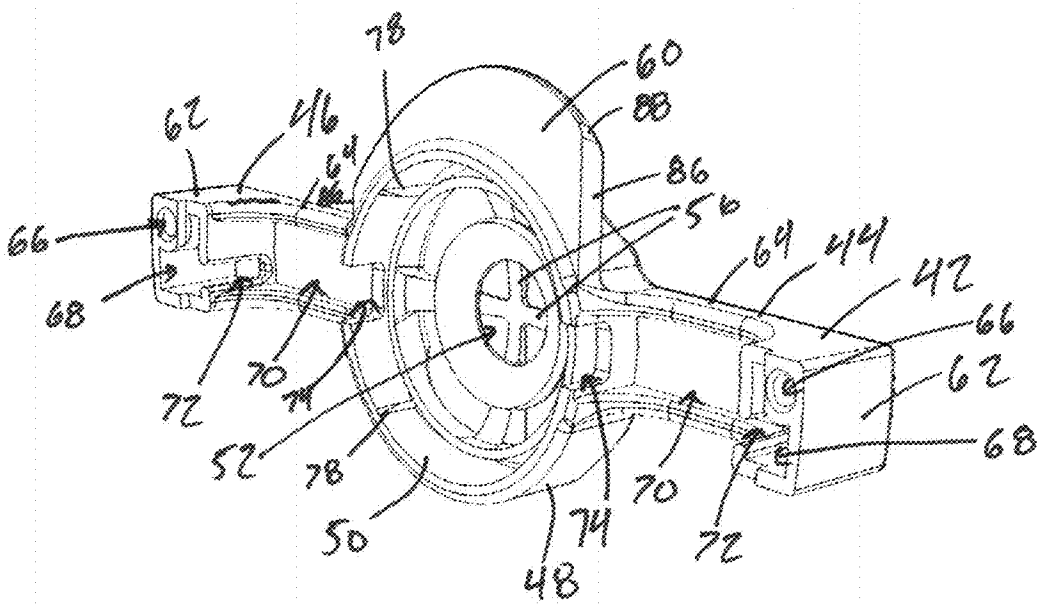
FIG. 7 is a rear perspective view of the bridge of FIG. 4.
Figure 8:
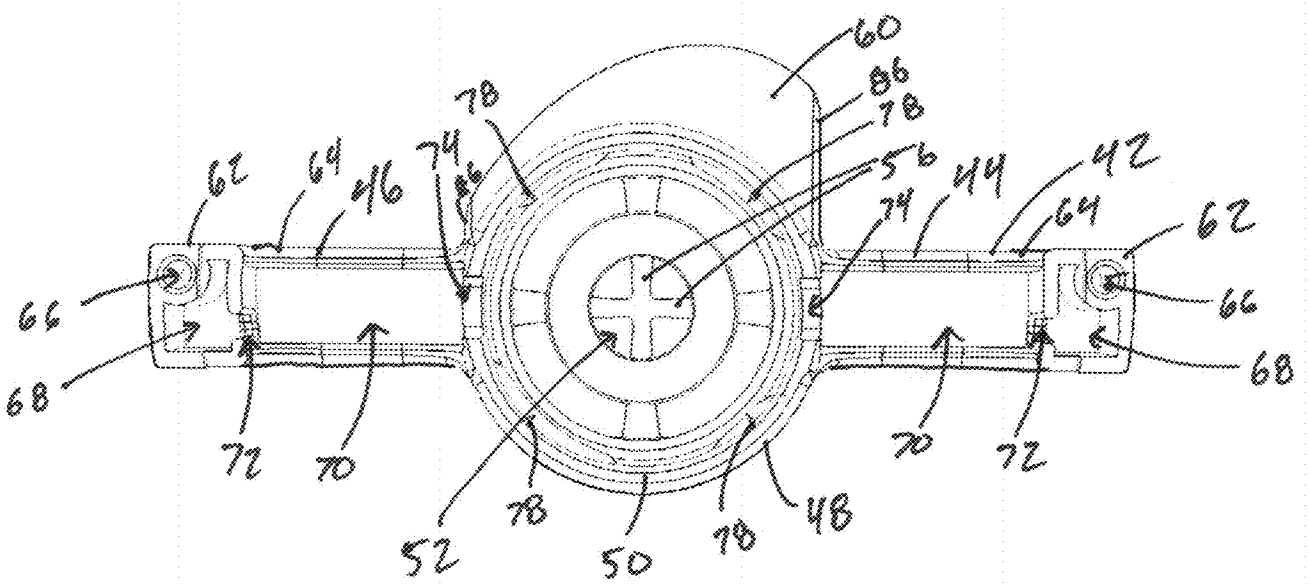
FIG. 8 is a rear plan view of the bridge of FIG. 4.
Figure 9:
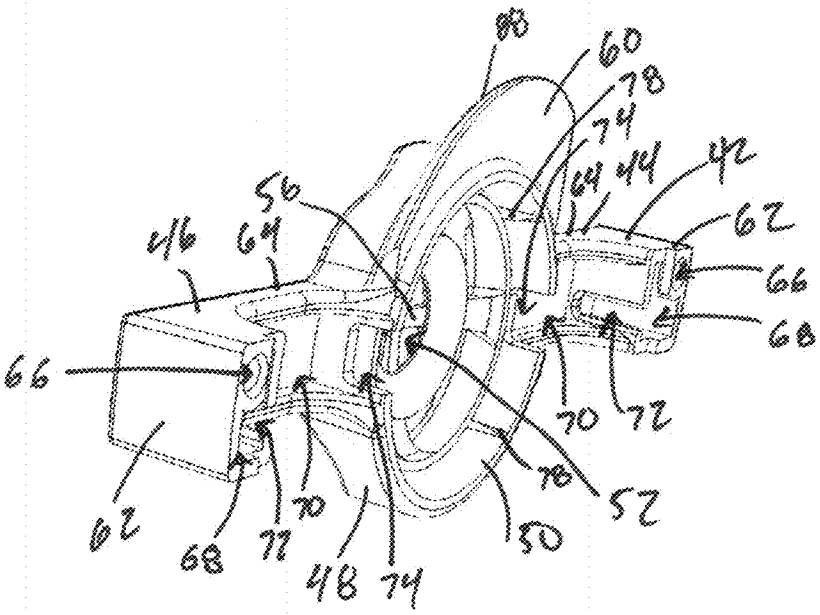
FIG. 9 is a rear perspective view of the bridge of FIG. 4.
Figure 10:
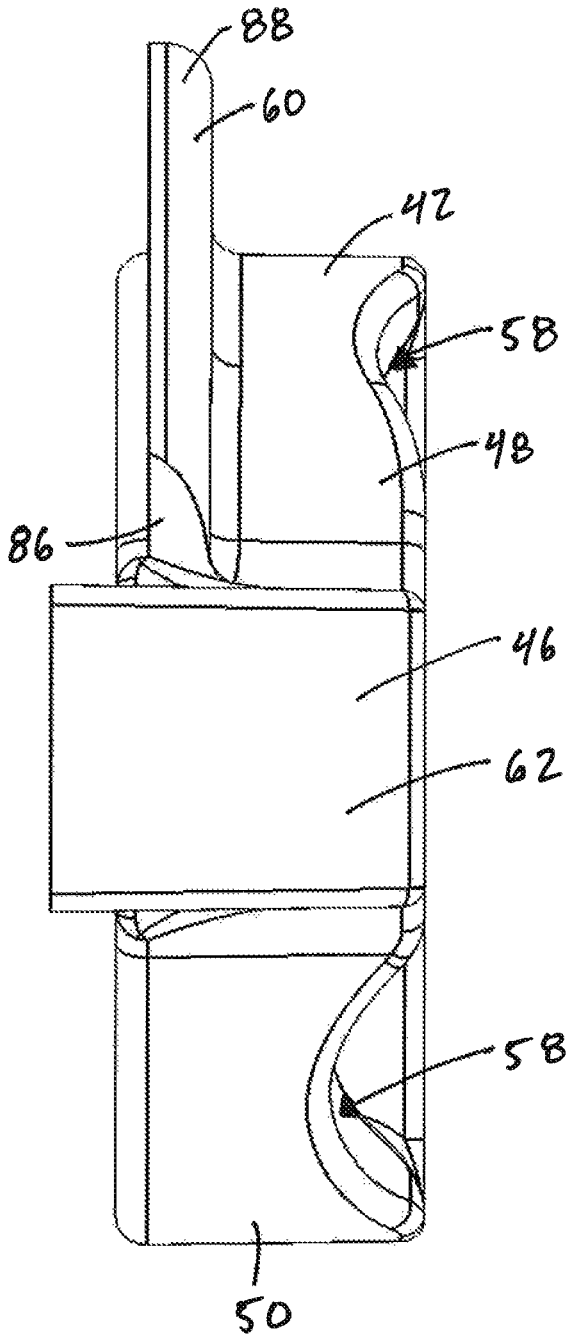
FIG. 10 is a side plan view of the bridge of FIG. 4.
Figure 11:
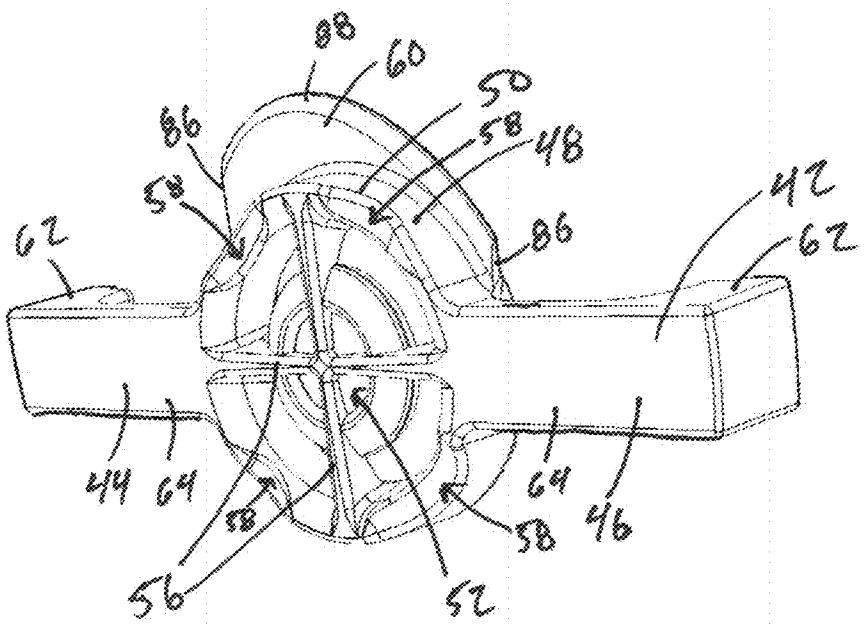
FIG. 11 is a front perspective view of the bridge of FIG. 4.
Figure 12A:
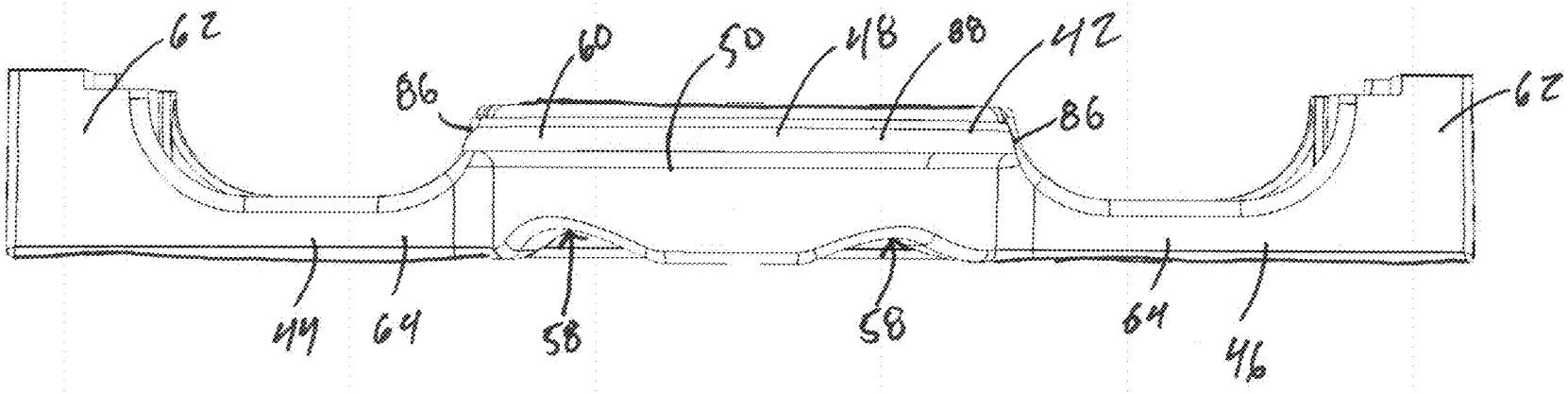
FIG. 12A is a top plan view of the bridge of FIG. 4.
Figure 12B:
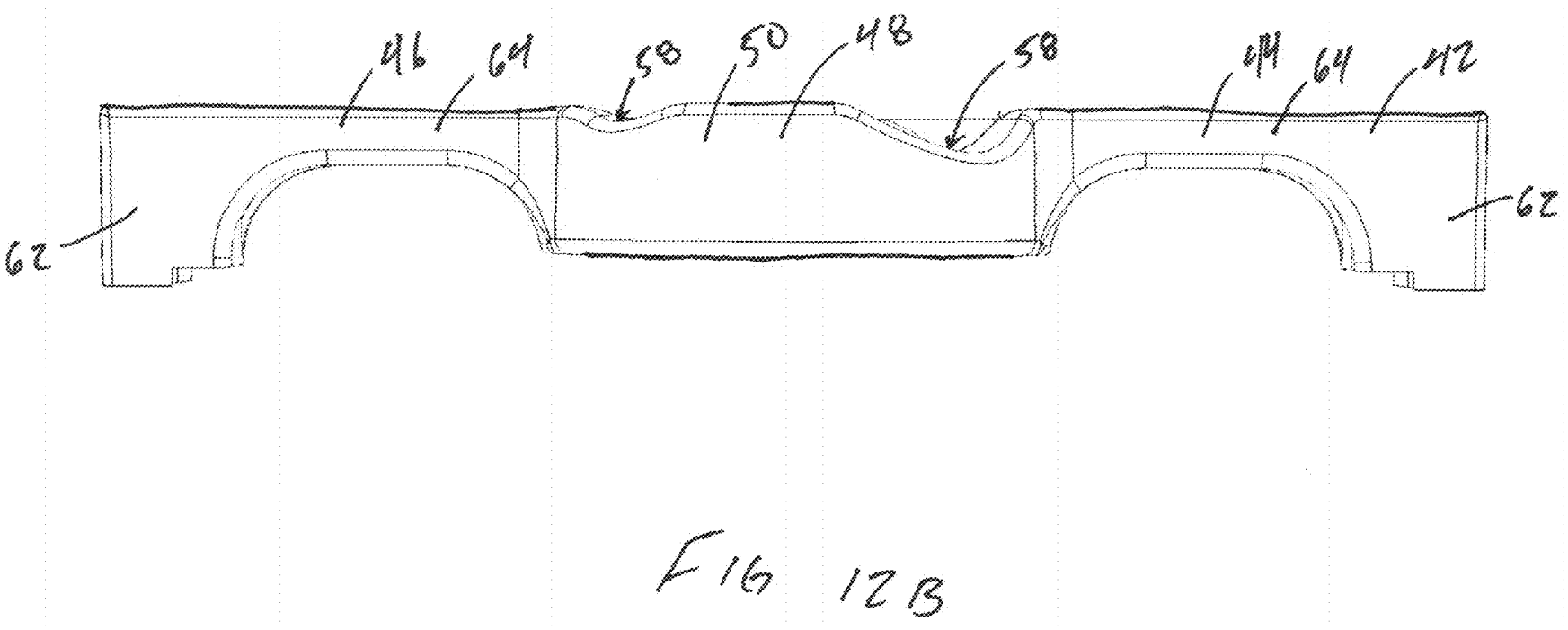
FIG. 12B is a bottom plan view of the bridge of FIG. 4.

As illustrated in FIG. 6, a first dimple 58*a* may be disposed above the arm 44, 46 of the bridge 42 and extend a first distance $d_1$ rearwardly from an outer surface of the rim portion 50 and a second dimple 58*b* may be disposed below the arm 44, 46 that extends a second distance $d_2$ rearwardly of the outer surface. The second distance may be less than the first distance $d_1$. However, in other embodiments, the second distance may be equal to, or greater than the first distance $d_1$. Each of the remaining dimples 58 may be different from the first and/or second dimples 58. Or, in some cases, some of the dimples 58 may be geometrically similar with some of the remaining dimples 58 while varied from other. Still further, in some examples, each of the dimples 58 may have a similar geometric shape and size, or a varied size.

Although illustrated in the example of FIGS. 4-12 as curved, the dimples 58 may be of any geometric shape and of any size. Moreover, the dimples 58 may extend outwardly from the rim portion 50 in some instances. In addition, the support section 48, or the bridge 42 as a whole, may be formed from a first material while the dimples 58 may include a second material. In such examples, the dimples 58 may be later attached to the bridge 42 and/or a multimaterial manufacturing process, such as multishot injection molding, may be utilized for forming the bridge 42. As provided herein, the dimples 58 can diffuse standing sound waves to provide a crisper and clear audio sound over a wider range of frequencies when compared to conventional speakers.

The support section may also include a protrusion that also assists in diffusion of standing sound waves. The protrusion may extend from the bridge, and consequently, the support section or the rim portion in any manner. For example, as illustrated in FIGS. 1-12B, the protrusion 60 is configured in a shark-fin shape that extends upwardly of the rim portion 50. As illustrated, the shark-fin shaped protrusion 60 extends radially about the rim portion 50 and has a first end portion 80 that extends a first distance $x_1$ from the rim portion 50. An intermediate portion 82 of the protrusion 60 extends a second distance $x_2$ from the rim portion 50 with the second distance $x_2$ being greater than the first distance $x_1$. A second end portion 84 extends a third distance $x_3$ from the rim portion 50 with the third distance $x_3$ being larger than the first and second distances $x_1$, $x_2$. As used herein, radial width, or arc length, is defined as a width about which a structure extends along another component of the speaker system. In instances in which the component is circular, the radial width may be defined by the degrees about which the structure extends along the circumference of the component relative to a center point of the circular component.

As illustrated in FIGS. 4-12B, the shark-fin shaped protrusion 60 can include a leading edge 86 that increases in height until an apex. At the apex, the distance from the rim portion 50 may then decrease through a trailing portion. The apex may have a radiused transition. Likewise, the leading edge and/or the trailing edge may be linear or curved as well. The protrusion may be formed of any other geometric shape without departing from the scope of the present disclosure. In some examples, the protrusion may be any shape that is asymmetrical.

The protrusion may extend along any radial width of the rim portion and can have an asymmetrical shape to assist in diffusing standing sound waves. For example, as illustrated in FIGS. 1-12B, the protrusion 60 may have a radial width that is between about 90 and 180 degrees the rim portion 50. However, the protrusion 60 may have a radial width that is less than 1 degree of the rim portion 50 to fully encompassing the rim portion 50 by extending 360 degrees about the rim portion 50. In some examples, one or more of the arms 44, 46 may also form protrusions 60 or have protrusions 60 (symmetrical or asymmetrical) extend therefrom and may have any geometric shape to alter diffuse standing sound waves of the speaker system 10. In some embodiments, such as the one illustrated in FIGS. 4-13, the first portion and the second portion of the protrusion 60 as both substantially perpendicular to the arms 44, 46. In addition, the protrusion 60 may be substantially parallel to a vertically oriented vane. It will be appreciated that the protrusion 60 may have any geometrical shape that extends about any magnitude of the rim portion 50 at any desired distance. Moreover, the protrusion 60 may extend a continuous or varied distance from the rim portion 50 in various examples.

An outer edge portion 88 of the protrusion 60 may have a radiused surface. As illustrated, the radiused surface may have a first side portion that is positioned forwardly of a second side portion. A continual, or varied, radius may extend between the first and second side portions. In some instances, instead of a radius, the outer edge portion 88 of the protrusion 60 may be chamfered. The curved surface may assist in increasing perceived quality of the component as well as assist in integrally forming the protrusion through an injection molding process.

Figure 13:
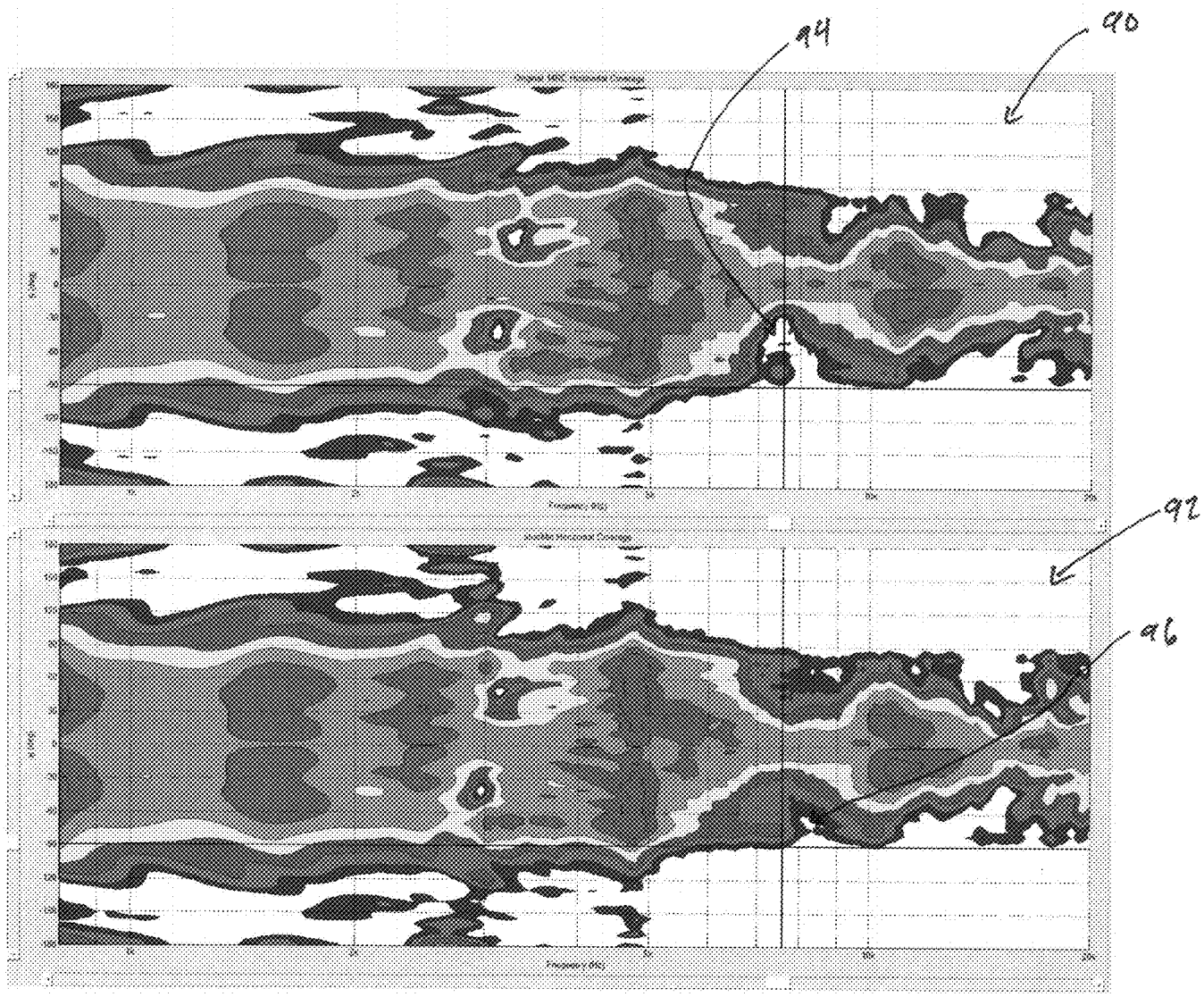
FIGS. 13 and 14 illustrate example sound maps without and with sound altering features positioned on the bridge, according to some examples in an off-axis condition.
Figure 14:
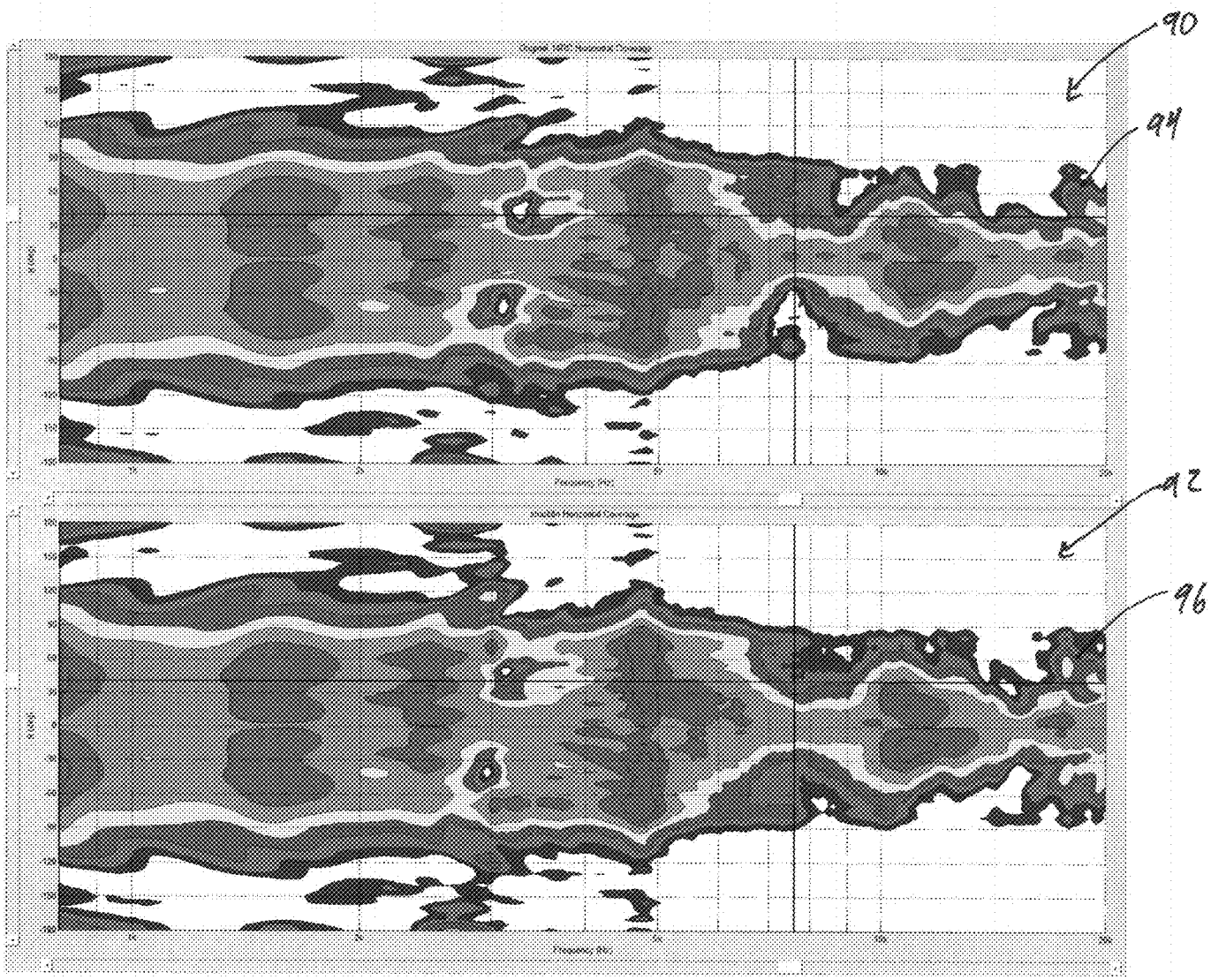

Referring to FIGS. 13 and 14, various Frequency Domain study plots were conducted by mapping the results obtained in a Time Domain that illustrate example sound maps of a conventional speaker sound map 90 versus the speaker assembly provided herein sound map 92 in an off-axis condition. FIGS. 13 and 14 illustrate sound maps 90, 92 with various bands of noise at various frequencies. As illustrated, tonal noise is altered by the dimples 58 and the protrusion 60, as can be seen by the varied frequency magnitudes 94, 96.

Figure 15:
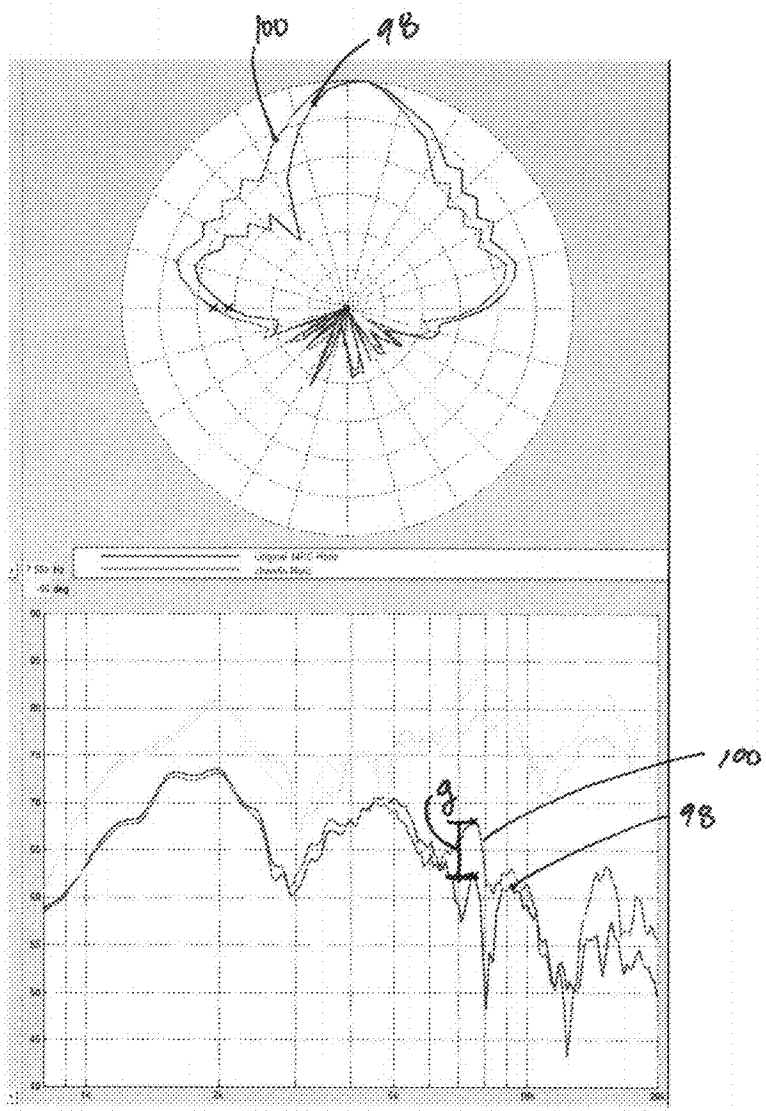
FIGS. 15 and 16 illustrate example frequency graphs without and with sound altering features positioned on the bridge, according to some examples in an off-axis condition.
Figure 16:
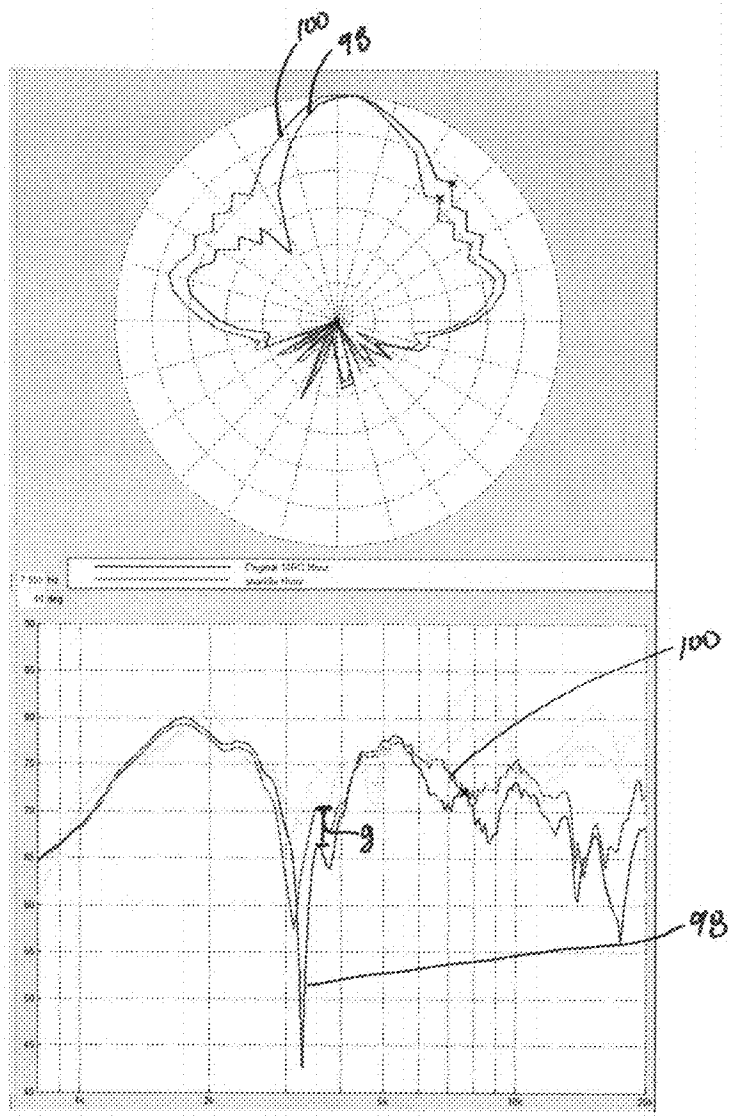

Likewise, FIGS. 15 and 16 further illustrate the sound map of a speaker without the dimples 58 and the protrusion 60, which is indicated by line 98, versus the speaker system 10 disclosed herein that includes the dimples 58 and the protrusion 60, which is indicated by line 100 in an off-axis condition. As illustrated, the usage of sound altering features can provide a fuller and/or crisper sound over a wide range of frequencies by altering an off-axis frequency response of the speaker output at various frequencies. In some examples, through the use of the sound altering features provided herein, the off-axis frequency may be improved, which may be advantageous for ceiling-mounted speaker systems, because a greater amount of acoustic energy is more balanced in the frequency response (i.e., the dips in the graphs), which is represented by line 100, representing acoustic pressure cancellation, which can get filled up by the order of 6-10 dB sound pressure level (SPL), when compared to conventional speaker systems, which is represented by line 98, as illustrated by the gain g.

Further, the sound altering features reduce geometrical symmetry to minimize the effect of sound cancellation happening at similar wavelengths due to contribution over the 360 degrees around a z-axis. As illustrated in FIG. 2, the speaker system may have a width that is defined by an x-axis and a height that is defined by a y-axis. A z-axis may be parallel to the first axis of the first diaphragm and/or extends away from the central point of the speaker system. In other words, the mounting plane of the speaker system may be along the z-axis and an intended projection of the pressure waves emanating from the speaker system may also be along the z-axis.

Figure 17:
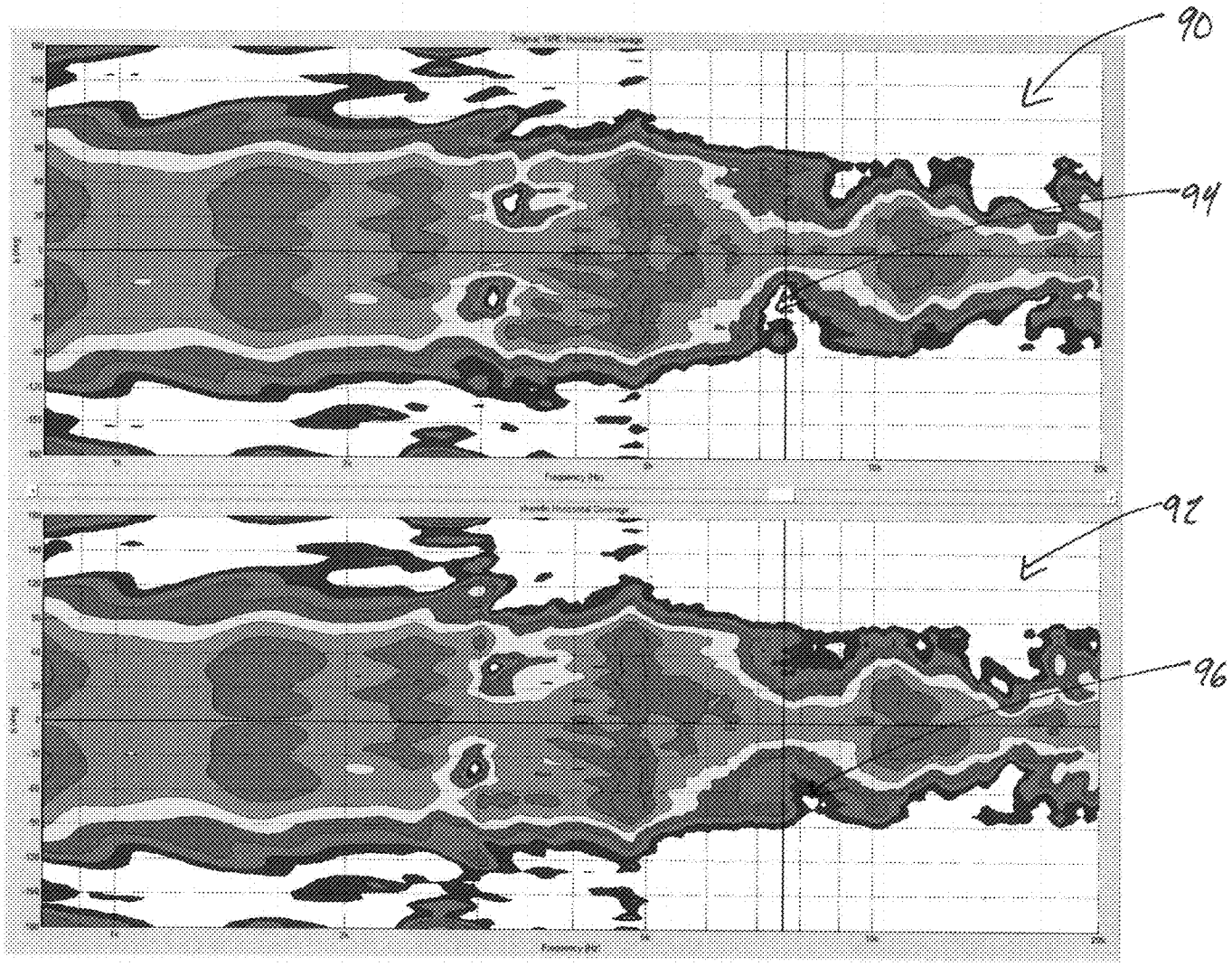
FIG. 17 illustrates example sound maps without and with sound altering features positioned on the bridge, according to some examples in an on-axis condition.
Figure 18:
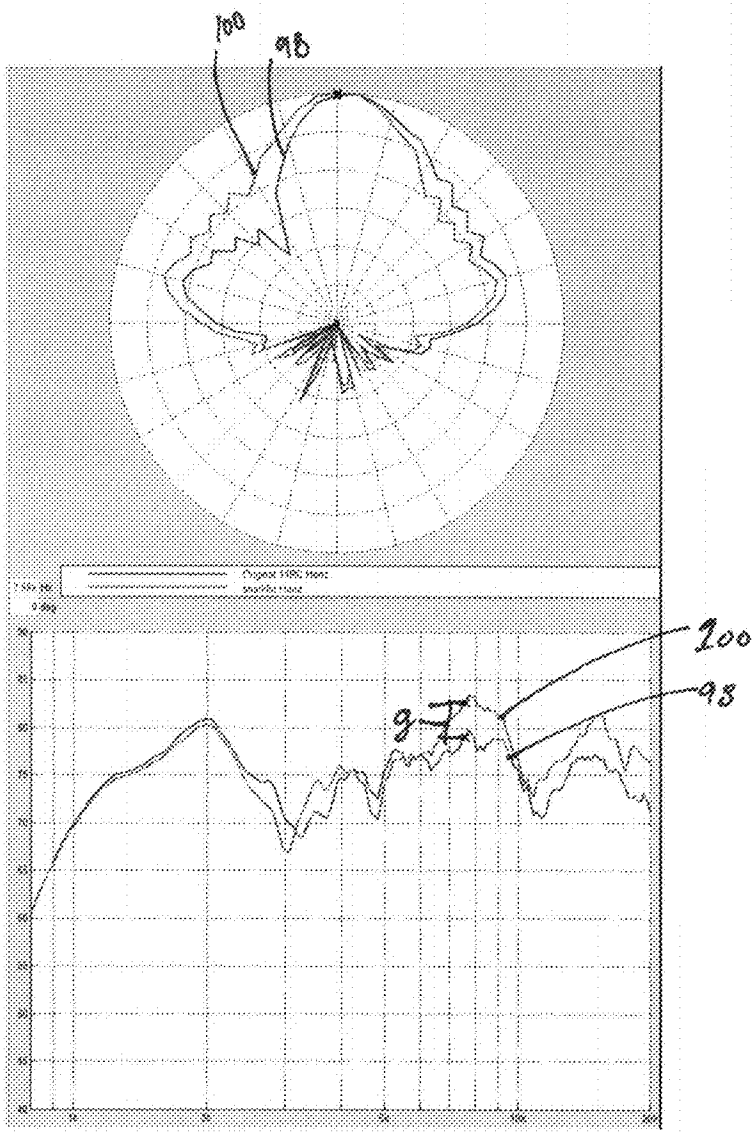
FIG. 18 illustrates example frequency graphs without and with sound altering features positioned on the bridge, according to some examples in an on-axis condition.

Referring to FIGS. 17 and 18, through the use of the sound altering features provided herein, the on-axis frequency may be also improved, as illustrated by the gain g, at various frequencies because a greater amount of acoustic energy is more balanced in the frequency response (i.e., the dips in the graphs), as generally represented by line 100, representing acoustic pressure cancellation, which can get filled up by the order of 6-10 dB SPL, when compared to conventional speaker systems, which is represented by line 98.

Use of the present disclosure may offer a variety of advantages. For instance, the speaker system can include various sound altering features that may be configured to alter an off-axis and/or on-axis frequency response of the speaker output at various frequencies. The alteration of the off-axis and/or on-axis frequency response can diffuse standing sound waves to provide a crisper and clear audio sound over a wider range of frequencies when compared to conventional speakers. The features may be integrally formed with the bridge through a single or multishot manufacturing process. As these features may be integrally formed with the bridge, the cost of enhancing the functionality of the speaker system is minimized.

It will be understood by one having ordinary skill in the art that construction of the described invention and other components is not limited to any specific material. Other exemplary examples of the invention disclosed herein may be formed from a wide variety of materials unless described otherwise herein.

For purposes of this disclosure, the term "coupled" (in all of its forms: couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

Furthermore, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected" or "operably coupled" to each other to achieve the desired functionality, and any two components capable of being so associated can also be viewed as being "operably couplable" to each other to achieve the desired functionality. Some examples of operably couplable include, but are not limited to, physically mateable, physically interacting components, wirelessly interactable, wirelessly interacting components, logically interacting, and/or logically interactable components.

It is also important to note that the construction and arrangement of the elements of the invention as shown in the examples are illustrative only. Although only a few examples of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connectors or other elements of the system may be varied, the nature or number of adjustment positions provided between the elements may be varied. It should be noted that the elements and/or assemblies of the system might be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary examples without departing from the spirit of the present innovations.

It will be understood that any described processes or steps within described processes may be combined with other disclosed processes or steps to form structures within the scope of the present invention. The exemplary structures and processes disclosed herein are for illustrative purposes and are not to be construed as limiting. In addition, variations and modifications can be made on the aforementioned structures and methods without departing from the concepts of the present invention and such concepts are intended to be covered by the following claims unless these claims by their language expressly state otherwise.

What is claimed is:

1. A speaker system, comprising:

a frame at least partially encompassing a first diaphragm of a first transducer;

a bridge operably coupled with the frame, wherein the bridge includes a support section and a pair of arms extending therefrom, the support section including a rim portion, wherein the rim portion defines a cavity therein and first and second vanes perpendicularly extend over the cavity;

a second transducer supported by the bridge and at least partially disposed within the rim portion;

a first sound altering feature disposed on a first side of the second transducer; and an asymmetrical second sound altering feature disposed on a second opposing side of the second transducer.

2. The speaker system of claim 1, wherein the first transducer is configured as a low frequencies and the second transducer is configured to output high frequencies.

3. The speaker system of claim 1, wherein the first sound altering feature is configured as a plurality of dimples disposed within a rim portion of the support section.

4. The speaker system of claim 3, wherein at least one of the plurality of dimples has an asymmetrical shape.

5. The speaker system of claim 3, wherein at least one of the plurality of dimples is asymmetric relative to at least one other of the plurality of dimples.

6. The speaker system of claim 1, wherein the second sound altering feature is configured as a protrusion that extends upwardly of the rim portion forming a sound altering waveguide feature.

7. The speaker system of claim 6, wherein the protrusion is configured to have a shark-fin shape that extends about an outer surface of the rim portion.

8. The speaker system of claim 1, wherein the first sound altering feature is configured as a set of four dimples, each dimple separated from adjacently located dimples by the first or second vane.

9. The speaker system of claim 1, wherein the second transducer moves along a second axis that is offset from a first movement axis of the first transducer.

10. The speaker system of claim 1, wherein a first arm of the pair of arms is a first length and a second arm of the pair of arms is a second length that is varied from the first length.

11. A speaker system, comprising:

a frame at least partially encompassing a first diaphragm of a first transducer;

a bridge operably coupled with the frame, wherein the bridge includes a support section and a pair of arms extending therefrom, the support section including a rim portion;

a second transducer supported by the bridge and at least partially disposed within the rim portion; and one or more dimples defined by the support section of the bridge, wherein at least one of the one or more dimples is defined by an asymmetrical geometric shape and wherein the one or more dimples includes a first dimple having a first radial width and a second dimple having a second radial width that is different from that of the first radial width.

12. The speaker system of claim 11, further comprising:

an asymmetrical second sound altering feature disposed on a second opposing side of the second transducer.

13. The speaker system of claim 11, wherein the second transducer moves along a second axis that is offset from a first movement axis of the first transducer.

14. The speaker system of claim 11, wherein the rim portion defines a cavity therein and first and second vanes perpendicularly extend over the cavity, and further wherein the one or more dimples is configured as a set of four dimples, each dimple separated from adjacently located dimples by the first vane or the second vane.

15. A speaker system, comprising:

a frame at least partially encompassing a first diaphragm of a first transducer;

a bridge operably coupled with the frame, wherein the bridge includes a support section and a pair of arms extending therefrom, the support section including a rim portion;

one or more dimples integrally formed within the rim portion, wherein the one or more dimples includes a first dimple having a first radial width and a second dimple having a second radial width that is different from that of the first radial width; and an asymmetrical protrusion extending from the rim portion.

16. The speaker system of claim 15, wherein at least one of the one or more dimples is defined by an asymmetrical geometric shape.

17. The speaker system of claim 15, wherein the protrusion extends upwardly from the rim portion between the pair of arms.

* * * * *